United States Patent [19]

Hammond

[11] Patent Number: 4,555,194

[45] Date of Patent: Nov. 26, 1985

[54] APPLICATOR WITH RESILIENT VALVE

[75] Inventor: Geoffrey R. Hammond, Hull, England

[73] Assignee: Reckitt & Colman Products Limited, London, England

[21] Appl. No.: 610,744

[22] Filed: May 16, 1984

[30] Foreign Application Priority Data

May 26, 1983 [GB] United Kingdom ..... 8314585

[51] Int. Cl.[4] ..... B05C 17/00

[52] U.S. Cl. ..... 401/206; 401/207; 401/273

[58] Field of Search ..... 401/206, 264, 273, 190, 401/186, 207

[56] References Cited

U.S. PATENT DOCUMENTS

| | | | |
|---|---|---|---|
| 2,557,917 | 6/1951 | Schlesinger | 401/264 X |
| 2,820,234 | 1/1958 | Rigney | 401/186 |
| 3,148,401 | 9/1964 | Gilchrist et al. . | |
| 3,296,649 | 1/1967 | Schwartzman | 401/206 |
| 3,356,441 | 12/1967 | Schwartzman | 401/206 |
| 3,370,908 | 2/1968 | Cupp | 401/190 |
| 3,410,645 | 11/1968 | Schwartzman | 401/206 X |
| 3,418,055 | 12/1968 | Schwartzman | 401/206 |
| 3,661,468 | 5/1972 | Schwartzman | 401/206 |

FOREIGN PATENT DOCUMENTS 1170341 11/1969 United Kingdom .

*Primary Examiner*—Steven A. Bratlie

*Attorney, Agent, or Firm*—Shlesinger, Fitzsimmons, Shlesinger

[57] ABSTRACT

An applicator for applying liquids to surfaces, especially highly mobile liquids of low viscosity, the applicator comprising a cap-like body (30) in a transverse wall (50) of which is a dispensing aperture (60). An applicator pad (90) is bonded to the outside of the transverse wall and there is a diaphragm (70) on the other side of the transverse wall, covering the dispensing aperture. The diaphragm (70) has a slit (80), radially spaced from the dispensing aperture.

An actuator member (100) extending through the dispensing aperture (60) rests with one end in contact with the diaphragm (70) and its other end in the applicator pad (90) so that pressure on the applicator pad (90) is transmitted via the actuator member (100) to displace the diaphragm (70) from the dispensing aperture (60) and open the slit (80).

The applicator resists accidental discharge of liquid and is particularly useful for applying treatment liquids to the leather of shoe uppers to impart a shine.

9 Claims, 5 Drawing Figures

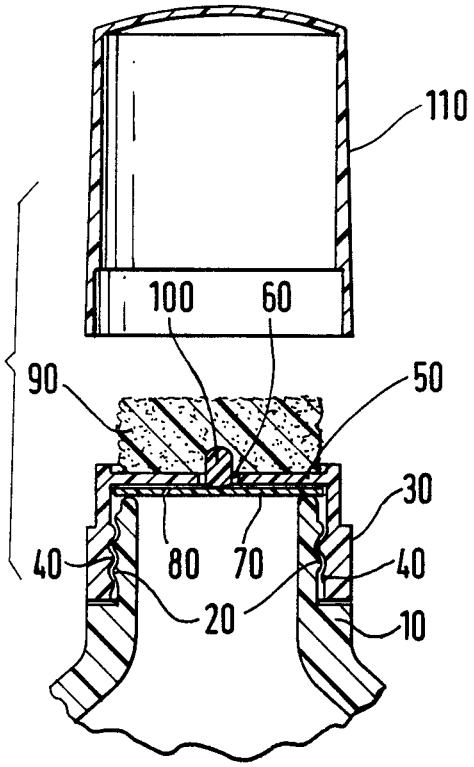
Fig.1.
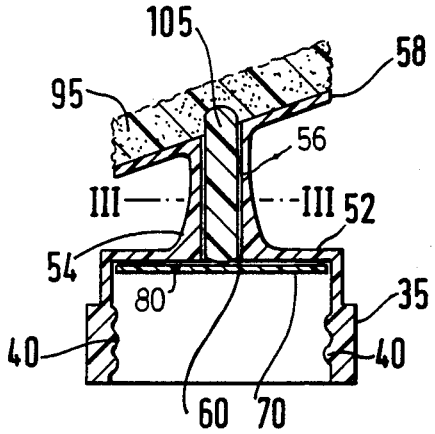
Fig.2.
Fig. 3(a)
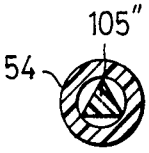
Fig. 3(b)
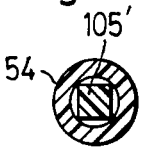
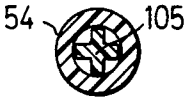
Fig.3(c)

APPLICATOR WITH RESILIENT VALVE

This invention relates to applicators for applying liquids to surfaces. Such devices incorporating a sponge or the like, are usually attached over the open mouth of a container for the liquid and there is frequently some means of metering the quantity of liquid flowing into the sponge, often brought into operation by movement of the sponge when pressed against a surface to be treated.

While such applicators may be used to apply a wide variety of liquid substances to many different surfaces, one particular field is that of spreading a very thin film of treatment liquid onto the leather of shoes to impart a shine. Such treatment liquids are often of low viscosity and highly mobile, and unless adequate precautions are taken, too much can be dispensed causing wastage and mess.

Many attempts have been made to produce an applicator which will perform satisfactorily under a wide range of conditions.

U.S. Pat. No. 3,148,401 issued to J. R. Gilchrist and M. C. Park in 1965 shows an applicator for a container of liquid in which a tubular body of resilient material has a sponge applicator at its working end and a diaphragm across the interior of the tubular body and spaced from the sponge. The diaphragm is provided with a slit of some arbitrary length. In use, the container, which may be perfectly rigid, is pushed towards the surface to be treated so that after the sponge applicator has come into contact with the surface, the tubular body distorts, causing the slit to open and allow liquid through to the space between the diaphragm and sponge. Pushing and releasing alternately on the bottle causes a pumping action at the working end of the tubular body, driving the liquid into the sponge for application to the surface. This device has achieved wide use but suffers from the disadvantage that to obtain the best results a combined pushing and rocking action is required and not all users achieve the requisite action, hence they find the device unsatisfactory in use.

U.S. Pat. No. 3,410,645 issued to G. Schwartzman in 1968 shows an applicator comprising a body having a projecting portion attached to a container. At the top of the projecting portion is a peripheral flange to which a sponge-like pad is bonded. A diaphragm, integral with the flange, has a plurality of normally closed slits. Also integral with the diaphragm is a stud extending into the pad, and upon depression of the pad and the stud the diaphragm flexes inwardly allowing the slits to open, so permitting fluid flow to the pad for application to the surface to be covered.

This device uses the known principle of slits in a diaphragm which open when the diaphragm is distorted. The slits do not, however, provide an adequate seal when the diaphragm is undistorted and so, during the process of forming the slits using hot knives, the hot plastic is allowed to re-seal the slits temporarily, thus "in a positive manner preventing any fluid flow until the seals which are frangible are broken".

British Pat. No. 1,170,341 granted in 1970 also to G. Schwartzman shows an applicator comprising a body adapted to be held in the neck of a container and having an integral flexible outwardly convex diaphragm with openings therein including a central hole. A valve body shaped as a segment of a sphere is held against the inner face of the diaphragm with its spherical surface in contact therewith by means of an integral stud passing through the central hole of the diaphragm. The convex surface of the valve body matches the concave inner surface of the undistorted diaphragm, effectively sealing the openings therein. There is a porous resilient cover over the outer face of the diaphragm forming an applicator surface.

When the device is pressed against a surface to be treated, the force on the porous resilient cover is transmitted to the diaphragm which flexes and its curvature decreases. The valve body moves away relative to at least some of the diaphragm openings, allowing the contents of the container to flow into the porous cover for application to the surface. Should pressure be applied to the container contents with the diaphragm undistorted, the valve body presses against the diaphragm, giving an effective seal.

One disadvantage of this device is the valve body which must, during assembly, have its stud inserted into the central hole of the diaphragm and the curvature of the diaphragm must be arranged to match exactly the curvature of the operating face of the valve body.

It is an object of the present invention to provide an applicator which overcomes the disadvantages of the prior art devices, is adaptable to a wide range of containers and liquids, and is relatively easily and cheaply made.

The invention provides an applicator for applying liquids to surfaces when attached over an open mouth of a container, the applicator comprising a substantially rigid body (30) engageable with the container mouth, an applicator pad (90) bonded to the body (30), a resilient diaphragm (70) associated with the body (30) and provided with a slit (80) for the passage of liquid from the container, and an actuator member (100) having an end in contact with the diaphragm (70) and the other end extending into the applicator pad (90) such that when the applicator pad (90) is pressed against a surface to be treated the actuator member (100) is displaced causing the diaphragm (70) to distort, opening the slit (80) and allowing liquid to flow from the container to the applicator pad (90), characterised in that the body (30) has a transverse wall (50) having a dispensing aperture for liquid in the container, the applicator pad (90) is bonded to the body (30) on one side of the transverse wall (50) remote from the container, the diaphragm (70) is located on the other side of the transverse wall (50) and adapted to cover the dispensing aperture (60), and the slit (80) in the diaphragm (70) is situated intermediate its periphery and that portion adapted to cover the dispensing aperture (60).

The rigid body of the applicator and the container mouth may conveniently be of substantially circular cross-section in which case the engagement between them is preferably by means of interengaging screw threads. The transverse wall has at least one dispensing aperture and in the minimum case this will conveniently be positioned in the centre of the transverse wall.

The actuator member may be rod-like, i.e. substantially cylindrical, or may taper towards the end remote from the diaphragm. It may be so dimensioned as to fill and close the dispensing aperture through which it extends when the diaphragm is undistorted. It may be convenient for the actuator member to be bonded to the diaphragm or to be formed integrally with it. In cross-section the actuator member need not be circular, but it may, with advantage, in some instances at least, be of non-circular cross section, e.g. triangular or cruciform.

The applicator pad is bonded to the rigid body by any of the known methods which will result in a secure, substantially permanent bond which remains unaffected by liquid which is to be dispensed. For greater security the bonded area will preferably extend over the whole area of that part of the rigid body with which it is in contact, i.e. the side of the transverse wall remote from the container or the corresponding side of an auxiliary surface spaced from the transverse wall. Such auxiliary surface may be at right angles to the general longitudinal axis of the rigid body or may be at an angle thereto. Such auxiliary surface will be provided with a dispensing aperture, means being provided also to lead liquid to be dispensed to said dispensing aperture from the dispensing aperture in the transverse wall.

The diaphragm, which is conveniently formed from a web of uniform thickness of an elastomeric material unaffected by contact with the liquid which is to be dispensed, is preferably arranged to be gripped at or near its periphery between the mouth of the liquid container and the transverse wall of the rigid body when said rigid body is fully engaged with the container mouth, so forming a good seal at the mouth.

The slit in the diaphragm may be straight or curved and preferably slopes from the vertical in the sense which permits easy opening of the slit when the diaphragm is distorted as a result of movement of the actuator member, and provides for an efficient seal to be formed when the diaphragm is allowed to return to its original configuration.

The invention will now be further described by way of example with reference to the drawings in which:

FIG. 1 is an exploded fragmentary sectional view of a container and cap therefor, and showing an applicator made according to one embodiment of this invention in position on the neck of the container;

FIG. 2 is a fragmentary sectional view of a modified applicator with an angled head and means for similarly positioning this applicator on a container neck, and FIGS. 3(*a*), 3(*b*) and 3(*c*) are cross sectional views as seen when viewed along the line III.III. in FIG. 2, and showing three different forms of actuators which may be employed in this invention.

Referring now to FIG. 1, a container for treatment liquid to be applied to surfaces has a cylindrical neck 10 provided with external screw threads 20 so as to receive a screw-on cap or the like in the usual manner. The applicator comprises a cylindrical rigid body 30, provided with internal screw threads 40 complementary to those on the container neck to permit it to be screwed thereon. The body also has a transverse wall 50 in which is a central dispensing aperture 60.

A circular diaphragm 70 of resilient material is held in contact with the transverse wall 50 of the rigid body, its margin being gripped between the transverse wall and the mouth of the container neck 10. There is a slit 80 in the diaphragm, offset from the centre, and inclined as shown to permit easy movement of the edges of the slit.

An applicator pad 90 of foam plastics material is bonded to the transverse wall 50 on the face remote from the container. An elongated actuator member 100, positioned in the transverse wall dispensing aperture 60, has one end in contact with diaphragm 70 whilst the other end extends into the applicator pad. A cover cap, 110, is provided to protect the applicator pad from dust and to prevent drying out when not in use. The cover cap is a friction fit on the outside of the rigid body 30 but other means of attachment such as inter-engaging beads, for example, may be used instead.

In normal use, after removal of the cover cap, the container is inverted and the applicator pad pressed on the surface to be treated. The pressing squeezes the applicator pad, so causing displacement of the actuator member and hence distortion of the diaphragm. This makes slit 80 open slighty, and the low viscosity and great mobility of the liquid in the container ensures that sufficient flows through to impregnate the applicator pad. A film of the liquid may then be transferred to the surface to be treated.

Turning now to the modification shown in FIGS. 2 and 3, wherein like numerals are employed to denote elements similar to those employed in the first embodiment, the rigid body 35 has internal screw threads 40 (as described previously) and a dispensing aperture 60 in a transverse wall 52. Extending away from the transverse wall is a stem portion 54 with a substantially uniform bore 56 throughout its length. The stem has at its free end an auxiliary surface 58 on which is bonded an applicator pad 95. An elongated actuator member 105, having a loose sliding fit in bore 56, is in contact with a diaphragm 70 (as described previously). The actuator member, which extends into the applicator pad is of non-circular cross section and may have a cross sectional configuration such as that of any one of the actuators denoted at 105″, 105′ and 105 in FIGS. 3(*a*), 3(*b*) and 3(*c*), respectively.

The rigid body 35 engages with the neck of a container of treatment liquid in the previously described manner and when fully engaged, the neck mouth grips the margin of the diaphragm 70 (as previously described).

In use, after removal of the cover cap, pressing the applicator pad on the surface to be treated displaces the actuator member. As the actuator member is of significant length in this embodiment, as compared to the actuator 100 in the first embodiment it relies on the guidance provided by the bore 56 of the stem portion 54, especially if the auxiliary surface is angled as shown in FIG. 2 and there is a lateral as well as an axial component to the force on the end of the actuator member. The cruciform section (see FIG. 3(*c*)) actuator member 105 is particularly useful in such a case.

If a container fitted with either embodiment of the invention is squeezed so that the liquid is forced against the diaphragm, the pressure on the diagragm closes the slit and presses the diaphragm firmly against the face of the transverse wall and the dispensing aperture. As the neck of the container is sealed to the margin of the diaphragm it is effectively sealed against egress of treatment liquid.

It will be appreciated that if the diaphragm is of uniform thickness some distortion of the diaphragm may take place when the diaphragm body is secured against the container neck. To avoid this possible defect the diaphragm preferably has a thickened peripheral region; conveniently of bead-like form, presented to the securing surfaces and, thereby, accidental deformation of the effective part of the diaphragm is avoided.

I claim:

1. An applicator for applying liquids to surfaces when attached over the open mouth of a container, the applicator comprising a substantially rigid body (30) engageable with the container mouth, an applicator pad (90) bonded to the body (30), a resilient, substantially plane diaphragm (70) associated with the body (30) and provided with a split (80) offset from the center of the diaphragm for the passage of liquid from the container, and an actuator member (100) having one end in contact with the diaphragm (70) and the other end extending into the applicator pad (90) such that when the applicator pad (90) is pressed against a surface to be treated the actuator member (100) is displaced causing the diaphragm (70) to distort, opening the slit (80) and allowing liquid to flow from the container to the applicator pad (90), characterized in that the body (30) has a transverse wall (50) having therethrough a dispensing aperture for liquid in the container, the applicator pad (90) is bonded to the body (30) over the end of said aperture that is remote from the container, the substantially plane diaphragm (70) is located on the side of the transverse wall (50) adjacent the container and engages the container mouth in sealing contact therewith and is adapted to cover the dispensing aperture (60), and the slit (80) in the diaphragm (70) is situated intermediate its zone of contact with the container mouth and that portion of the diaphragm adapted to cover the dispensing aperture (60).

2. An applicator as claimed in claim 1 characterised in that the substantially rigid body (30) is of substantially circular cross-section.

3. An applicator as claimed in claim 2 characterised in that the substantially rigid body (30) has screw threads (40) for engaging with the container mouth.

4. An applicator as claimed in claim 1, characterised in that the actuator member (100) tapers towards the end thereof remote from the diaphragm (70).

5. An applicator as claimed in claim 1, characterised in that the actuator member (100) is of noncircular cross-section.

6. An applicator as claimed in claim 1, characterised in that the actuator member (100) is bonded to the resilient diaphragm (70).

7. An applicator as claimed in claim 1, characterised in that the substantially rigid body has an auxiliary surface (58) spaced from the transverse wall (52) and onto which auxiliary surface is bonded the applicator pad (95).

8. An applicator as claimed in claim 7 characterised in that the auxiliary surface (58) is inclined to the general longitudinal axis of the substantially rigid body.

9. An applicator as claimed in claim 1, characterised in that the slit (80) in the resilient diaphragm (70) lies in a plane inclined towards the actuator member (100).

* * * * *